US005776270A

United States Patent [19]

Biondich

[11] Patent Number: 5,776,270

[45] Date of Patent: Jul. 7, 1998

[54] METHOD FOR REFORMING A CONTAINER AND CONTAINER PRODUCED THEREBY

[75] Inventor: Scott C. Biondich, Delmont, Pa.

[73] Assignee: Aluminum Company of America, Pittsburgh, Pa.

[21] Appl. No.: 582,005

[22] Filed: Jan. 2, 1996

[51] Int. Cl.[6] ..... C22F 1/00

[52] U.S. Cl. ..... 148/696; 148/697; 148/696; 148/695; 148/688; 148/566; 148/570; 72/56

[58] Field of Search ..... 148/697, 696, 148/695, 688, 566, 570; 72/56

[56] References Cited

U.S. PATENT DOCUMENTS

| | | | |
|---|---|---|---|
| D. 356,501 | 3/1995 | Komick et al. . | |
| 1,711,445 | 4/1929 | Burvenick . | |
| 2,787,973 | 4/1957 | Heidmann . | |
| 3,224,239 | 12/1965 | Hansson . | |
| 3,383,890 | 5/1968 | Wildi . | |
| 3,413,432 | 11/1968 | Homann . | |
| 3,599,461 | 8/1971 | Asti | 72/56 |
| 3,654,788 | 4/1972 | Kimura | 72/56 |
| 3,810,372 | 5/1974 | Queyroix | 72/56 |
| 3,810,373 | 5/1974 | Queyroix | 72/56 |
| 4,307,276 | 12/1981 | Kurata et al. . | |
| 4,947,667 | 8/1990 | Gunkel et al. | 72/56 |
| 5,058,408 | 10/1991 | Leftault, Jr. et al. | 72/56 |
| 5,353,617 | 10/1994 | Cherian et al. | 72/56 |

*Primary Examiner*—David A. Simmons
*Assistant Examiner*—M. Alexandra Elve
*Attorney, Agent, or Firm*—Alan G. Towner; Thomas R. Trempus

[57] ABSTRACT

A method for reforming the generally cylindrical sidewalls of aluminum containers is disclosed. The method produces highly expanded and/or contoured container sidewalls which provide a distinctive appearance in comparison with cylindrical containers having straight sidewalls. Multiple expansion steps are used to expand the sidewall to a diameter substantially greater than the initial diameter of the cylindrical starting container. The sidewalls are thermally treated prior to expansion, for example, by annealing to reduce or eliminate residual stresses and work hardening. The sidewall thickness of the cylindrical starting container is preferably selected in order to maximize the total amount of sidewall expansion that can be achieved.

26 Claims, 3 Drawing Sheets

METHOD FOR REFORMING A CONTAINER AND CONTAINER PRODUCED THEREBY

BACKGROUND OF THE INVENTION

The present invention relates to a method for reforming containers, and more particularly to a method for reforming at least a portion of the sidewalls of generally cylindrically shaped containers using multiple expansion steps. The method may be used to form aluminum containers having highly contoured sidewalls. The present invention also relates to highly contoured aluminum containers formed by a multiple expansion and thermal treatment process.

Various methods are known in the art for shaping articles such as metallic containers. U.S. Pat. Nos. 1,711,445 and 3,224,239, for example, disclose methods in which a plunger and compressed air cooperate to bulge container sidewalls against the face of an adjacent die. U.S. Pat. No. 2,787,973 pertains to a method for hydraulically expanding a container into tight contact with a surrounding mold. High voltage discharge forming of containers against a fixed mold is described, for example, in U.S. Pat. No. 3,654,788. These and other methods result in reforming the sidewalls of thin walled containers to conform to a mold configuration against which the sidewalls are directed.

Another working method known in the art is called magnetic forming or electromagnetic forming. Such a method involves forming materials with the use of magnetic fields of relatively high intensity. In electromagnetic forming an electrical current is passed through a coil consisting of a conductive wire which is typically supported by a nonconductive structure. The current produces a pulsed magnetic field which induces a current in an adjacent conductive workpiece. The induced current in the workpiece reacts with the magnetic field to produce a force which is directed against the adjacent workpiece. Exemplary electromagnetic forming coils are described in U.S. Pat. Nos. 3,383,890 and 3,599,461.

A method of magnetomotive forming of cylindrical objects such as cans is disclosed in U.S. Pat. No. 3,810,373. This method involves subjecting the object to a very high outwardly directed force wherein the object is compressed against a surrounding die. An exemplary die, described in U.S. Pat. No. 3,810,372, is used for forming selected impressions in the cylindrical object.

An improved electromagnetic process for forming cylindrical cans is disclosed in U.S. Pat. No. 4,947,667. The method involves expanding at least a portion of a cylindrical sidewall of a generally cylindrically shaped, electrically responsive metallic body. A coil of electrically conductive material is placed inside the metallic body, and then energized to create an electromagnetic force sufficient to expand at least a portion of the generally cylindrical sidewalls of the metallic body outwardly of the original generally cylindrical shape. The method is stated as being capable of attaining a maximum increase in container diameter of up to 20 percent.

It is also known in the prior art to use induction heating for the purpose of annealing tubular articles prior to subsequent forming operations. For example, U.S. Pat. No. 3,413,432 discloses the induction heating of a metal tube prior to circumferentially enlarging the tube ends. U.S. Pat. No. 4,307,276pertains to a method of uniformly heating long steel pipes by passing the pipes through one or more induction heating coils to heat treat the pipe.

An improved method for thermally treating portions of cylindrical aluminum container sidewalls is disclosed in U.S. Pat. No. 5,058,408. The method involves a single heat treatment step wherein at least a portion of the cylindrical sidewall of the container is inductively heated to reduce its yield strength by about 20 percent. After the thermal treatment, the thermally treated sidewall portion is bulged to provide the final container shape.

Despite prior work in the container shaping area, there is still a need for further improvement to provide a method for forming container bodies which are highly expanded and/or contoured. For example, it would be desirable to form aluminum cans with bulged sidewalls having diameters at least 20 percent greater than the starting cylindrical sidewalls. It would also be desirable to form distinctive aluminum cans having expanded, highly contoured sidewalls, such as shown in U.S. Pat. No. DES 356,501. Conventional forming methods have proven unsatisfactory for the production of such highly expanded or contoured containers.

Each of the above-referenced patents is incorporated herein by reference.

The present invention has been developed in view of the foregoing and to overcome other deficiencies of the prior art.

SUMMARY OF THE INVENTION

An object of the present invention is to provide a method for reforming the sidewalls of aluminum containers which produces highly expanded contoured sidewalls.

Another object of the present invention is to provide a multiple expansion process for reforming generally cylindrical sidewalls of aluminum containers into highly expanded and/or contoured shapes. The process preferably includes an annealing treatment prior to each expansion step which reduces or eliminates residual stresses and work hardening.

A further object of the present invention is to provide a method for reforming the sidewalls of generally cylindrical aluminum containers wherein the starting thickness of the cylindrical sidewall is selected to maximize the total amount of expansion that can be achieved. The starting sidewall thickness is also selected to provide a highly contoured final sidewall capable of withstanding the desired amount of axial load.

Another object of the present invention is to provide highly contoured aluminum containers produced by a method of expanding at least a portion of a generally cylindrical aluminum sidewall to form an intermediate sidewall of increased diameter, thermally treating at least the expanded portion of the intermediate sidewall, and expanding the thermally treated portion of the intermediate sidewall to form a final sidewall having a final diameter substantially greater than the initial diameter of the starting cylindrical sidewall. The sidewall may be expanded to a final diameter more than 20 percent greater than the initial diameter, and may include indented and raised portions which provide containers with highly distinctive appearances.

DETAILED DESCRIPTION OF THE PREFERRED EMBODIMENTS

The present invention is directed to a method for reforming the sidewalls of containers, and the containers formed thereby. The containers which may be reformed by this invention generally include cylindrical cans, such as food, beer and beverage cans. The cans are preferably made from aluminum, and may be coated with various protective coatings or decorated before and/or after the reforming operation. The reforming process produces highly contoured cans having sidewalls with outward circumferential bulges and/or indentations.

In accordance with the present invention, multiple expansion steps are performed on a cylindrical starting can, with a thermal treatment preferably employed between each expansion step. The multiple-step expansion method of the present invention produces highly contoured reshaped sidewalls which are expanded to dimensions not possible with conventional forming techniques.

Although the use of aluminum cans is primarily described herein, it is understood that other metal and metal-containing cans may be used in accordance with the method of the present invention. The term "aluminum" as used herein includes substantially pure aluminum as well as aluminum alloys. Exemplary aluminum alloys suitable for use in accordance with the present invention include Aluminum Association 3xxx series alloys such as 3004, 3104 and 3204, and 5xxx series alloys such as 5352and 5052.

Figure 1:
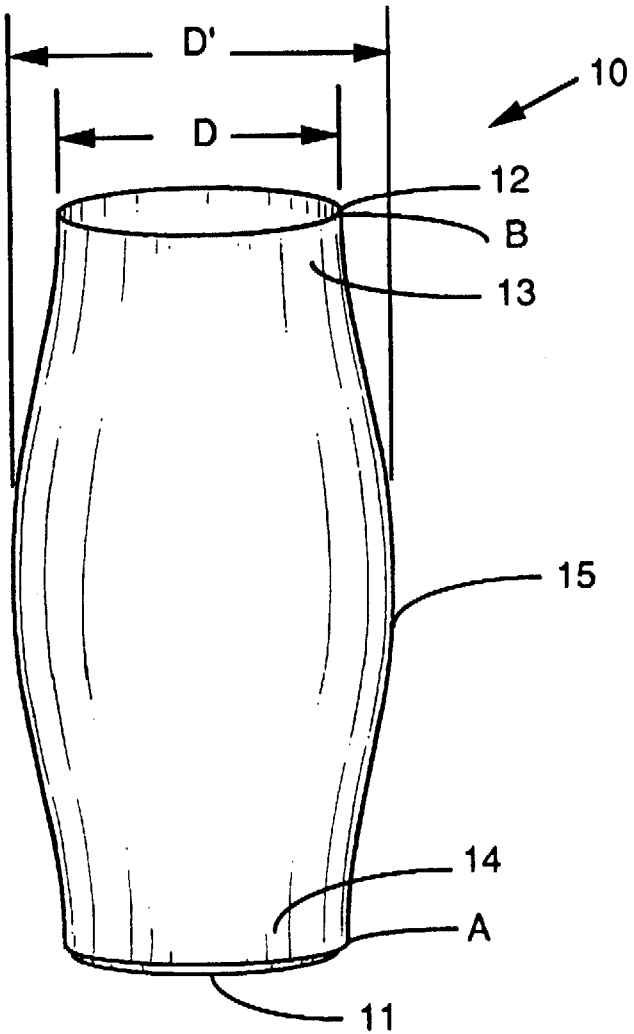
FIG. 1 is a perspective view of the sidewall of an aluminum can reformed in accordance with the method of the present invention.

Referring to the drawings, wherein like reference numerals represent like elements throughout the several figures, FIG.1 is a perspective view of a can 10 which has been reformed in accordance with the process of the present invention. The can 10 includes a bottom 11 and an open top 12. The open top 12 may be necked and fitted with a cap (not shown) in a conventional manner in order to seal the container once it has been filled. The container 10 includes a sidewall extending from point A to point B comprising generally circular upper and lower portions 13 and 14, which correspond substantially with the diameter of the starting cylindrical container prior to the reforming process. The sidewall also includes a bulged or expanded portion 15 which, in the embodiment shown in FIG. 1, is located towards the middle of the sidewall. While a single bulge 15 in the middle of the sidewall is shown in FIG. 1, multiple bulges and/or bulges located along other portions of the sidewall are within the scope of the present invention. Prior to the reforming process, the cylindrical sidewall of the container has an external diameter D which, in the embodiment shown in FIG. 1, is retained by the upper portion 13 and lower portion 14 of the sidewall after the container has been reformed. The expanded portion 15 of the sidewall has an external diameter D' which is substantially greater than the starting diameter D. For example, the expanded diameter D' may be more than 20 percent greater than the starting diameter D in order to provide a highly contoured final product. Preferably, the expanded diameter D' is at least 25 percent greater than the starting diameter D, and more preferably at least 30 percent greater, depending on the particular can shape that is desired.

Figure 2:
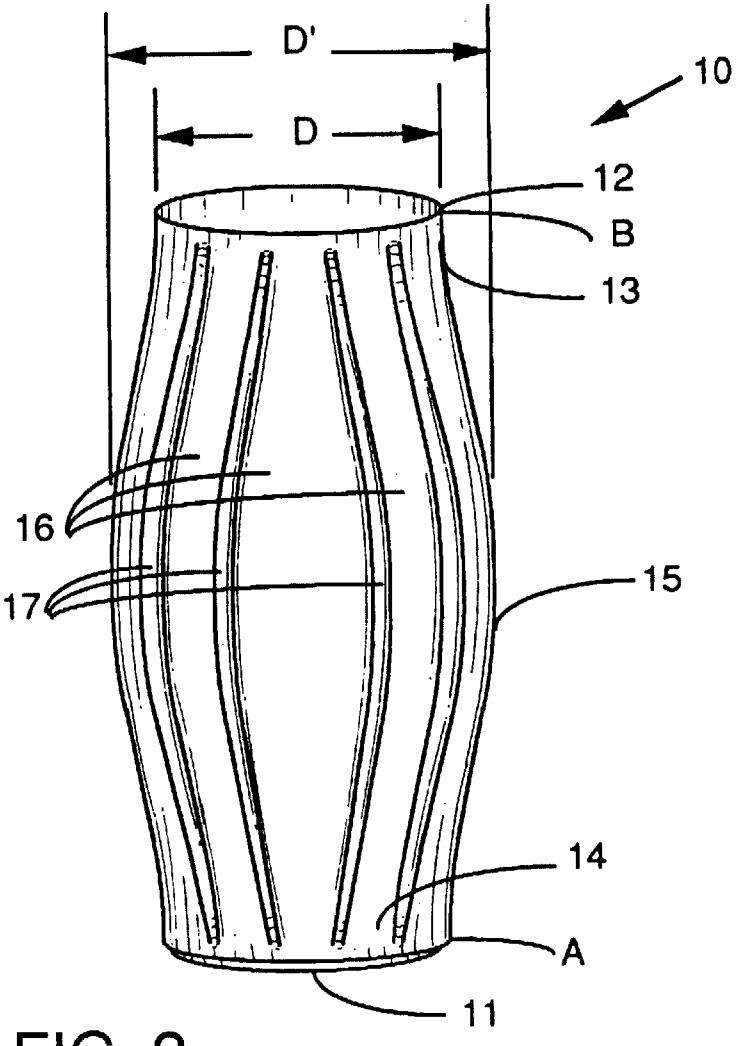
FIG. 2 is a perspective view of another sidewall of an aluminum can reformed in accordance with the method of the present invention.

FIG. 2 illustrates another reformed can which may be produced in accordance with the process of the present invention. The can 10 includes a bottom 11 and an open top 12, as well as a sidewall extending from point A to point B comprising upper and lower portions 13 and 14 having diameters corresponding substantially with the diameter of the cylindrical starting can. The sidewall of the container includes an expanded portion 15 having a substantially increased external diameter D' in comparison with the starting external diameter D of the can. The sidewall of the can is highly contoured with a series of raised portions 16 and indented portions 17 extending in a generally longitudinal direction along the sidewall of the can. In the embodiment shown in FIG. 2, the can 10 is both expanded to an increased diameter D', and is also provided with highly contoured raised portions 16 and indentations and 17. In forming such a highly contoured can, the aluminum sidewall is deformed in a radial direction to form the expanded portion 15, and is also locally deformed to provide the contoured raised and indented portions 16 and 17. The multiple-step reforming method of the present invention enables such highly deformed aluminum sidewalls to be produced without fracturing the sidewalls. While a specific configuration of raised portions 16 and indented portions 17 is shown in FIG. 2, it is to be understood that any other suitable highly contoured design can be fabricated in accordance with the present invention. For example, the present method may be used to produce transverse or spiral indentations, alpha numeric symbols, and the like.

In accordance with the method of the present invention, the starting cylindrical can may be formed by any suitable conventional process. For example, the can may be drawn and ironed, drawn and redrawn, impact extruded, etc. Two-piece cans may be used in accordance with the present invention, wherein the starting can comprises an integral bottom and sidewall to which the lid is attached after the can has been filled. Alternatively, the present process may be used in conjunction with three-piece cans wherein the cylindrical sidewall is provided separately from the bottom and top pieces. The use of drawn and ironed two-piece cans is particularly suitable for use in accordance with the present method. However, the use of three-piece cans may allow the cylindrical sidewalls to be treated separately from the bottom portions, and may allow for the use of different alloys for the sidewalls and bottoms. For example, the sidewalls could be made from an aluminum alloy that is not work hardened to such an extent as the alloy used for the bottom pieces.

Aluminum can bodies having sidewall diameters of about 2 to 3 inches, as well as other can sizes, are suitable for use in accordance with the present invention. For example, a standard 2.6 inch diameter can may be us ed with the present method. The can is preferably selected such that in the reformed condition the bottom holds 90 psi and the sidewalls are capable of withstanding an axial load of at least 250 pounds. Aluminum sidewall thicknesses of the starting can of 0.003 to 0.012 inch are preferred in accordance with the present invention, with starting thicknesses of 0.004 to 0.010 inch being particularly suitable for most reforming operations. In the fully expanded condition, sidewall thickness of 0.003 to 0.010 inch are preferred, with final thickness of 0.004 to 0.009 inch being particularly suitable for most cans. Since the reformed cans produced in accordance with the present invention possess highly contoured sidewalls, which may be less capable of withstanding axial loads in comparison with straight cylindrical sidewalls, it is preferable to provide sufficiently thick reformed sidewalls that can withstand the desired amount of axial load. In accordance with one embodiment of the present invention, the sidewall of the starting can may be provided with areas of increased thickness in the areas which are subjected to the greatest expansion, as more fully described below.

In accordance with the preferred embodiment of the present invention, the starting cylindrical can is thermally treated to reduce or eliminate any residual stresses or work hardening induced during the formation of the can, such as work hardening resulting from drawing and/or ironing operations. The thermal treatment step may produce full annealing to the 0 temper, or may produce partial annealing. For most aluminum alloy compositions, partial annealing at a temperature ranging from about 450° to 650°F. for a time of about 0.05 to 20 minutes is suitable, with higher annealing temperatures generally requiring shorter treatment times. For substantially eliminating any work hardening of the aluminum sidewall, annealing temperatures of from 500° to 700° F. for 0.01 to 30 minutes are preferred, with annealing temperatures of 600° to 650° F. for 2 seconds to 1 minute being particularly preferred. In order to increase production rates it may be desirable to use relatively high temperatures which require less time to produce the desired amount of annealing. However, where protective or decorative coatings are applied to the starting cans before the annealing step, the annealing temperature should be low enough such that the coatings are not substantially degraded. The entire sidewall of the starting can may be annealed in a suitable furnace. Alternatively, selected portions of the sidewall may be annealed by induction coils as set forth in U.S. Pat. No. 5,058,408. Where a two-piece can having an integral bottom and sidewall is used as the starting can, it is preferable to selectively anneal the sidewall without heating the bottom portion to such an extent that would substantially weaken the bottom.

After the sidewall of the starting cylindrical can has been thermally treated, the sidewall is subjected to an initial expansion step which reforms the can into an intermediate expanded shape. This initial expansion step may include the use of an electromagnetic forming process, or any other suitable type of conventional process such as pneumatic, hydraulic, mechanical, elastomeric, explosive, and spin forming techniques. The initial expansion step may include the expansion of the annealed sidewalls into free space without the use of an external die as shown in FIG. 3, or may include the use an external die as shown in FIG. 4.

Figure 3:
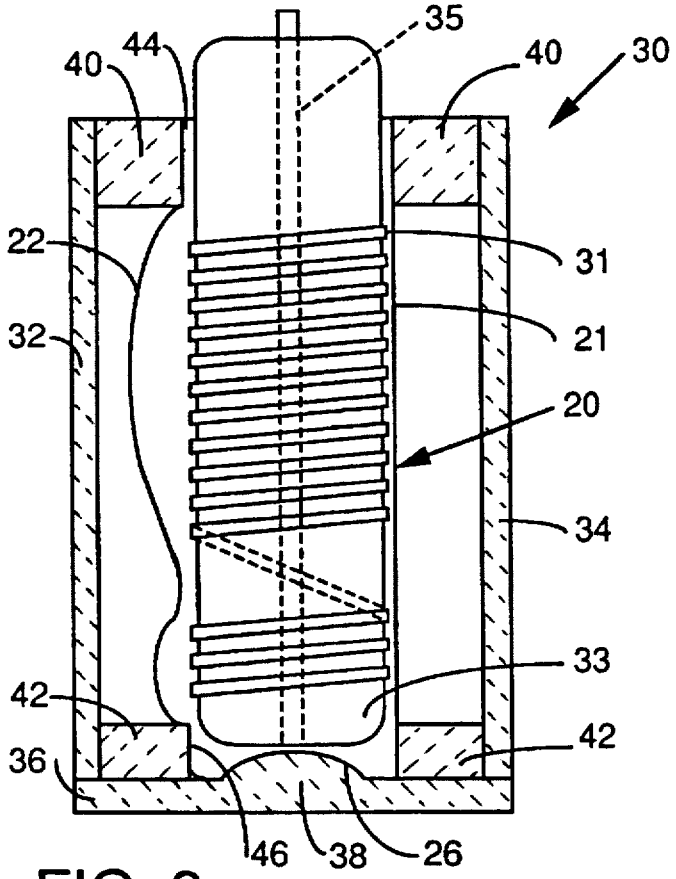
FIG. 3 is a cross-sectional side view of an electromagnetic sidewall reforming fixture suitable for use in accordance with the present invention.

FIG. 3 illustrates an electromagnetic forming fixture which is suitable for use in the expansion steps of the present invention. The fixture 30, which may be similar to that described in U.S. Pat. No. 4,947,667, includes outside walls 32 and 34 and an end wall 36. The end wall 36 may be provided with an inwardly projecting rib 38 generally matching the contour of the domed bottom end wall 26 of the can body 20 which is positioned within the fixture 30. The can body 20 is illustrated in the right portion of FIG. 3 as having a substantially straight cylindrical sidewall 21 prior to the initial expansion step. After the initial expansion, the sidewall of the can body 20 is expanded to the intermediate reformed shape 22 shown in the left portion of FIG. 3. The fixture 30 also includes a first ring 40 and a second ring 42 having inside faces 44 and 46 respectively defining the inside diameter of the rings 40 and 42. The inside faces 44 and 46 provide locations for lateral end portions of the container to seat, rest and maintain the dimensions of the end portions during the initial reforming operation. Preferably, the inside diameter of the inside faces 44 and 46 are substantially equal to the outside diameter of the upper and lower sidewall portions of the container to be reformed by this process. The fixture is preferably a multiple-piece assembly which can be readily opened and closed to position and remove the can before and after the initial reforming step.

In accordance with the embodiment shown in FIG. 3, a coil 31 is used to exert electromagnetic force on the sidewalls of the can body 20. The coil 31 is wound around a hollow aluminum central conductor or core 33 which supports the coil 31 and provides mechanical and electrical connections to a capacitor power supply, not shown. A passageway 35 is provided in the core 33 in order to allow for the introduction of air into the interior volume of the can 20 during the reforming process, as fully described in U.S. Pat. No. 4,947,667.

Figure 4:
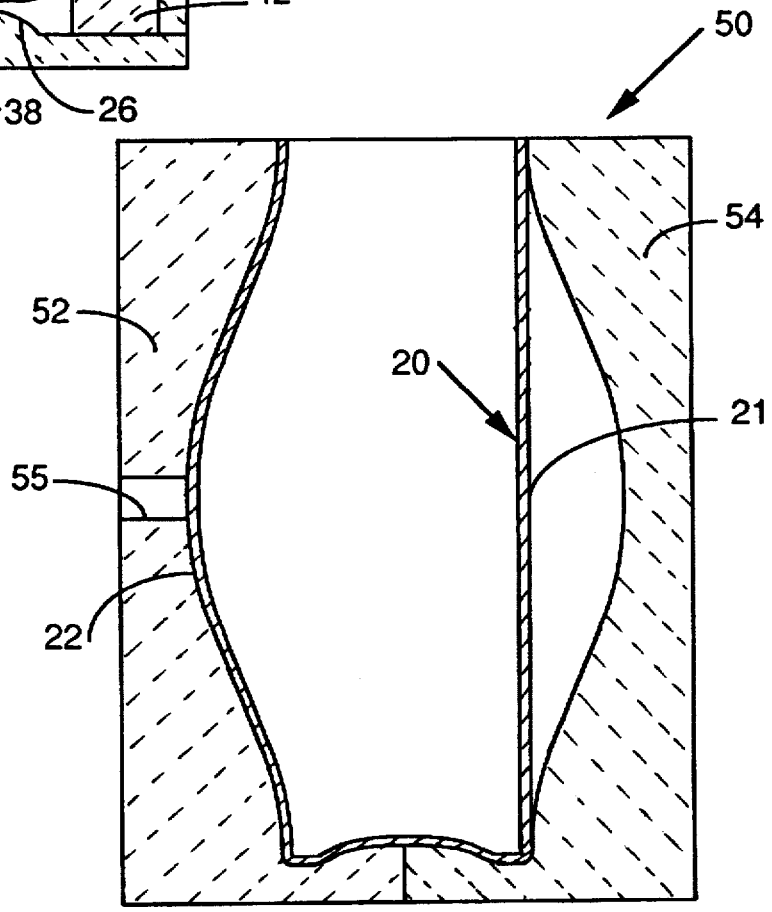
FIG. 4 is a cross-sectional side view of a sidewall reforming fixture including an external die suitable for use in accordance with another embodiment of the present invention.

In an alternative embodiment shown in FIG. 4, an external die fixture 50 is used in the expansion steps of the present invention. The fixture 50 includes a multiple-piece assembly comprising a left portion 52 and a right portion 54. Although a two-piece external die fixture is shown in FIG. 4, fixtures with three or more portions may be used in accordance with the present invention. A can body 20 is placed within the fixture 50 having a substantially straight cylindrical sidewall 21 prior to the initial expansion step, as shown in the right portion of FIG. 4. After the initial expansion by means of electromagnetic or other deformation techniques, the can body 20 conforms to the interior surface of the external die portions 52, 54 to provide the intermediate reformed shape 22, as shown in the left portion of FIG. 4. An opening 55 is provided in at least one of the external die portions 52 and 54 in order to alleviate the build up of pressure that would otherwise occur between the interior walls of the die portions 52 and 54 and the external surface of the can body 20 during the reforming operation. Prior to the initial reforming step, the volume between the can body 20 and external die portions 52 and 54 may be evacuated to further prevent the unwanted build up of pressure during the reforming process.

Figure 5:
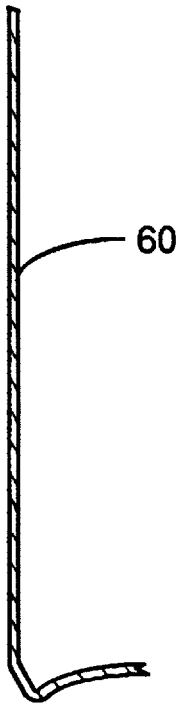
FIG. 5 is a partial cross-sectional side view of a generally cylindrical starting can having a uniform sidewall in accordance with an embodiment of the present invention.
Figure 6:
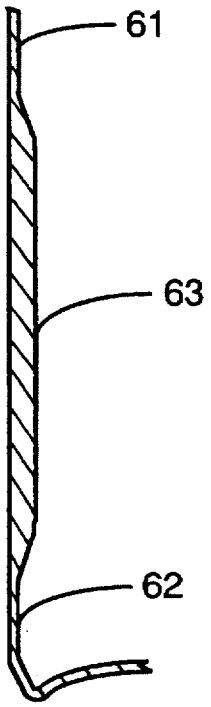
FIG. 6 is a partial cross-sectional side view of a generally cylindrical starting can having a sidewall of non-uniform thickness in accordance with an alternative embodiment of the present invention.

In one embodiment of the present invention, the starting thickness of the cylindrical sidewall may be substantially uniform. As illustrated in the cross-sectional side view of FIG. 5, the sidewall 60 of the starting can may have a uniform thickness over its entire area. However, in an alternative embodiment, the starting sidewall thickness may be varied in order to provide additional metal in the area of expansion. As shown in the cross-sectional side view of FIG. 6, the sidewall of the starting can may have relatively thin sections 61 and 62, and a relatively thick section 63 in the area to be expanded. Thus, the middle of the starting sidewall may be provided with an area of increased thickness 63 as shown in FIG. 6 for the production of highly contoured sidewalls as shown in FIGS. 1 and 2 having a single expansion zone in the middle of the sidewall. While a single area of increased thickness is shown in FIG. 6, it is to be understood that multiple zones of increased thickness and/or zones located along other portions of the sidewall are possible. As explained more fully below, the use of a starting sidewall of increased thickness has been found in accordance with the present invention to increase the maximum expansion that can be obtained by the method of the present invention. The use of a starting sidewall with increased thickness may also produce a final can that is capable of withstanding greater axial loads.

The initial reforming step of the present invention preferably expands the can to an intermediate expanded diameter from about 2 to about 20 percent greater than the initial diameter of the starting can. More preferably, the intermediate expanded diameter is from about 3 to about 15 percent greater than the starting diameter, and most preferably from about 4 to about 10 percent greater. The amount of expansion achieved in the initial expansion step is preferably selected to be greater than the amount of expansion that could be achieved for a conventional cylindrical can having work hardened sidewalls. For example, in a conventional 3004 H19 alloy cylindrical can having a sidewall thickness of 0.0040 inch, an expansion of about 3 percent would typically lead to fracturing of the sidewall. However, in accordance with the preferred embodiment of the present invention, the use of an initial thermal treatment permits an initial expansion of well over 3 percent for a similar alloy of similar thickness. For instance, an initial expansion of 5 or 10 percent or more may be readily achieved for a 3004 alloy having a sidewall thickness of 0.0040 inch in accordance with the present invention.

In the initial expansion step of the present invention, the maximum amount of expansion is selected such that fracturing of the sidewall is prevented. For most aluminum alloys having typical sidewall gauges, the initial expansion may be limited to 20 percent or less. Typically, the initial expansion may be restricted to amounts of 15 percent or less, for sidewall thickness of 0.0040 inch. However, in accordance with the present invention, the use of increased sidewall thicknesses of, for example, 0.0067 inch enables greater expansion in the initial step. Thus, depending on the alloy composition and sidewall thickness selected, the initial expansion step of the present invention preferably produces an amount of expansion which would fracture a typical, unannealed aluminum sidewall, but which does not fracture the thermally treated sidewalls, and which maximizes the total amount of expansion that can subsequently be achieved.

After the sidewall has been expanded to the intermediate expanded diameter, it is preferably thermally treated an amount sufficient to reduce or eliminate residual stresses or work hardening in the expanded region. The thermal treatment may comprise annealing at least the expanded portion of the sidewall at a preferred temperature ranging from about 450° to 700° F. for a preferred time ranging from about 0.01 to 10 minutes, with higher annealing temperatures generally requiring shorter treatment times. More preferably, this annealing step may be carried out at a temperature of 500° to 700° F. for 0.05 to 10 minutes. In some cases it may be sufficient to partially anneal the sidewall in order to allow for the desired amount of expansion. However, it may be desirable to fully anneal the expanded portion of the sidewall to the 0 temper such that substantially all work hardening has been eliminated in order to maximize the amount of expansion that can be achieved.

After the initial expansion and subsequent thermal treatment step, the sidewall is subjected to a second expansion step which expands the sidewall to a final expanded diameter greater than the intermediate expanded diameter. Preferably, the sidewall is expanded to a final expanded diameter at least 5 percent greater than the intermediate expanded diameter, and more preferably to a final expanded diameter at least 10 percent greater than the intermediate expanded diameter.

Alternatively, the intermediate expanded sidewall may be expanded to the final diameter without the use of a thermal treatment step prior to the final expansion step, provided that the starting cylindrical can is thermally treated prior to the initial expansion step. Thus, for example, the starting cylindrical sidewall may be thermally treated prior to the initial expansion step an amount sufficient to allow for expansion to an intermediate diameter up to about 20 percent greater than the initial diameter, followed by a second expansion step which expands the sidewall to the final diameter without an intervening thermal treatment. In this embodiment, the second expansion step produces a final expanded diameter that is typically from about 1 to about 6 percent greater than the intermediate expanded diameter.

In accordance with the present invention, the term "final expanded diameter" is used to describe the diameter of the fully expanded sidewall after the sidewall has been subjected to the multiple expansion steps of the present invention. While two expansion steps are primarily described herein, it is to be understood that three or more expansion steps are possible in accordance with the invention, preferably with an appropriate thermal treatment between each additional expansion step. Thus, for example, a sidewall of intermediate expanded diameter may be expanded to a second intermediate expanded diameter, annealed as described above, and subsequently expanded to the final expanded diameter. Such additional steps may require the use of starting cans with substantially increased sidewall thickness in the area of expansion.

The process used for the second expansion step may be similar to that used for the initial step. Thus, for example, electromagnetic, pneumatic, hydraulic, mechanical, elastomeric, explosive, and spin forming methods may be used in the second expansion step. A fixture similar to that shown in FIG. 3 may be used in the second expansion step. Alternatively, a fixture as shown in FIG. 4 with an external die may be used for the second expansion step. Where the volume of the fully expanded container is to be controlled within relatively high tolerances, it may be preferred to use an external die fixture in order to repeatedly form containers having the same volume. In addition, the use of an external die in the final expansion step is preferable for the formation of highly contoured cans having indentations in the form of designs and/or alphanumeric symbols, such as the design shown in FIG. 2.

Each expansion step of the present invention is preferably performed quickly in order to yield satisfactory production rates. The metal deformation process typically takes less than one minute, preferably less than 10 seconds, and more preferably less than one second. For example, when an electromagnetic reforming process is used, the sidewall of the can is expanded almost instantaneously, thereby allowing extremely fast production rates. Each expansion step is typically carried out at a strain rate $\epsilon$ (per second) greater than 1, preferably greater than 10, and more preferably greater than 100. Furthermore, each expansion step may be performed at room temperature. Thus, after each thermal treatment, the sidewall may be allowed to cool to room temperature prior to expansion. Alternatively, the thermally treated sidewall may be expanded before the sidewall has cooled to room temperature, or upon reheating to an elevated temperature.

The following examples illustrate various aspects of the present invention and are not intended to limit the scope of the invention.

EXAMPLE 1

A generally cylindrical drawn and ironed can body with an open top similar to that conventionally used for making two-piece aluminum cans is provided as a starting can. The starting can is made of Aluminum Association alloy 3004 in the H19 temper having a uniform sidewall thickness of 0.0040 inch. The can has a diameter of 2.595 inch, conventionally designated as a 211 diameter can. The can is baked at 385° F. for 10 minutes in order to simulate the curing of a protective coating applied to the interior of the can in the same manner as conventional aluminum cans. The can is loaded in a electromagnetic reforming fixture similar to that shown in FIG. 3, and then electromagnetically expanded to a diameter of 2.670 inch, beyond which point it fractures. The can thus exhibits a maximum expansion in diameter of 2.9 percent. The expanded sidewall has a thickness of 0.0039 inch, corresponding to a metal thinning of 2.5 percent.

EXAMPLE 2

Example 1 is repeated except instead of baking at 385° F. for 10 minutes, the can is fully annealed at 625° F. for 30 minutes. The thermally treated can is then expanded to a maximum diameter of 3.040 inch, representing a maximum expansion in diameter of 17.1 percent. The expanded sidewall has a thickness of 0.0034 inch, representing a metal thinning of 15 percent.

EXAMPLE 3

Example 2 is repeated except the diameter of the thermally treated can is initially expanded by 10 percent to form an intermediate sidewall, followed by a full anneal at 625° F. for 30 minutes and a final expansion to a maximum expanded diameter of 3.136 inch. The sidewall of the can is thus expanded to a final expanded diameter 20.8 percent greater than the initial diameter of the starting can. The resulting sidewall has a thickness of 0.0033 inch, representing a metal thinning of 17.5 percent.

The results of Examples 1–3 are summarized in Table 1 below.

TABLE 1

Expansion Obtained For Cans With 0.0040 Inch Sidewalls

| | Ex. 1 | Ex. 2 | Ex. 3 |
|---|---|---|---|
| Diameter Expanded to | 2.670 | 3.040 | 3.136 |
| % Expansion | 2.9% | 17.1% | 20.8% |
| Metal Thickness | 0.0039 | 0.0034 | 0.0033 |
| % Metal Thinning | 2.5% | 15% | 17.5% |

As shown in Table 1, the use of two separate expansion steps with a full anneal before each step results in the ability to expand the 0.0040 inch sidewall to an increased diameter of 20.8 percent. Without the two-step process of the present invention, the fully annealed 0.0040 inch sidewall can only be expanded to a diameter 17.1 percent greater than the initial diameter. Thus, the multiple-step expansion process of the present invention produces a 21.6 percent increase in expansion in comparison with a single-step expansion method performed on a fully annealed can. Moreover, the multiple expansion method of the present invention produces over a 700 percent increase in expansion in comparison with a single-step expansion performed on an unannealed can.

EXAMPLE 4

Example 1 is repeated except a starting can with an increased sidewall thickness of 0.0067 inch is used. Upon electromagnetic reforming, a maximum diameter of 2.753 inch is achieved, representing a 6 percent expansion in diameter. The thickness of the expanded sidewall is 0.0064 inch, representing a metal thinning of 4.5 percent.

EXAMPLE 5

Example 2 is repeated except a starting can with an increased sidewall thickness of 0.0067 inch is used. After the starting cylindrical can has been subjected to a full anneal at 625° F. for 30 minutes, it is expanded to a maximum diameter of 3.209 inch, representing a 23.7 percent expansion in diameter over the starting can. The expanded sidewall has a thickness of 0.0055 inch, representing a metal thinning of 17.9percent.

EXAMPLE 6

Example 3 is repeated except a starting can with an increased sidewall thickness of 0.0067 inch is used. After a full anneal at 625 ° F. for 30 minutes, the sidewall of the can is expanded to an intermediate expanded diameter 10 percent greater than the initial diameter. The intermediate product is then fully annealed at 625° F. for 30 minutes, followed by electromagnetic expansion to a final expanded diameter of 3.371 inch, representing a total expansion in diameter of 29.9 percent.

The thickness of the final sidewall is 0.0051 inch, representing a metal thinning of 23.9 percent.

EXAMPLE 7

Example 6 is repeated except the diameter of the sidewall is initially expanded by 15 percent rather than 10 percent to form the intermediate product. The intermediate product is fully annealed at 625° F. for 30 minutes, followed by expansion to a maximum expanded diameter of 3.298 inch, representing a total expansion in diameter of 27.1 percent. The final sidewall thickness is 0.0051 inch, representing a metal thinning of 23.9 percent.

The results of Examples 4–7are summarized in Table 2 below.

TABLE 2

Expansion Obtained For Cans With 0.0067 Inch Sidewalls

| | Ex. 4 | Ex. 5 | Ex. 6 | Ex. 7 |
|---|---|---|---|---|
| Diameter Expanded to | 2.723 | 3.209 | 3.371 | 3.298 |
| % Expansion | 6% | 23.7% | 29.9% | 27.1% |
| Metal Thickness | 0.0064 | 0.0055 | 0.0051 | 0.0051 |
| % Metal Thinning | 4.5% | 17.9% | 23.9% | 23.9% |

As shown in Table 2, the use of the multiple-step expansion method of the present invention incorporating a full anneal before each expansion step results in a substantial increase in the amount of expansion that can be achieved. For instance, a can produced in accordance with the multi-step process of Example 6 is expanded to a diameter 29.9 percent greater than the starting diameter, while the sidewall diameter of the can produced in accordance with the single-step expansion process of Example 5 is only expanded to a diameter 23.7 percent greater than the initial diameter. Thus, the multiple-step expansion process of the present invention is demonstrated as producing a 12.6 percent increase in expansion in comparison with a single-step expansion method performed on a fully annealed can. Moreover, the multiple expansion method of the present invention is demonstrated to produce almost a 500 percent increase in expansion in comparison with a single-step expansion performed on an unannealed can.

A comparison of the results presented in Tables 1 and 2 demonstrates that the total amount of expansion can be increased by increasing the thickness of the starting sidewall in accordance with the present invention. For instance, comparing the results obtained in Example 3 for a starting sidewall thickness of 0.0040 inch with the results obtained in Example 6 for a starting sidewall thickness of 0.0067 inch for the same alloy, a total expansion of 29.9 percent is achieved with the thicker sidewall versus 20.8 percent for the thinner sidewall. Thus, in accordance with a preferred embodiment of the present invention, the thickness of the starting sidewall is selected in order to maximize the amount of final expansion that can be achieved.

While particular embodiments of the present invention have been described for purposes of illustration herein, it will be recognized by those skilled in the art that numerous variations of the details may be made without departing from the invention as set forth in the appended claims.

I claim:

1. A method of reforming a sidewall of a generally cylindrically shaped portion of an aluminum container comprising:

providing a generally cylindrical aluminum sidewall having an initial diameter;

expanding at least a portion of the generally cylindrical sidewall to form an intermediate sidewall having an intermediate expanded diameter greater than the initial diameter;

thermally treating at least the expanded portion of the intermediate sidewall; and expanding the thermally treated portion of the previously expanded intermediate sidewall to form a final sidewall having a final expanded diameter greater than the intermediate diameter.

2. The method of claim 1, wherein the intermediate expanded diameter is at least 5 percent greater than the initial diameter.

3. The method of claim 1, wherein the intermediate expanded diameter is from 2 to 20 percent greater than the initial diameter.

4. The method of claim 1, wherein the final expanded diameter is at least 5 percent greater than the intermediate expanded diameter.

5. The method of claim 1, wherein the final expanded diameter is more than 20 percent greater than the initial diameter.

6. The method of claim 2, wherein the final expanded diameter is more than 20 percent greater than the initial diameter.

7. The method of claim 1, including:

thermally treating at least a portion of the generally cylindrical aluminum sidewall prior to expanding the sidewall to the intermediate expanded diameter.

8. The method of claim 7, wherein the generally cylindrical aluminum sidewall is thermally treated by annealing the sidewall to the 0 temper.

9. The method of claim 7, wherein the generally cylindrical aluminum sidewall is thermally treated by subjecting the sidewall to a temperature of from 450° to 650° F. for 0.05 to 20 minutes.

10. The method of claim 1, wherein the intermediate sidewall is thermally treated by annealing the sidewall to the 0 temper.

11. The method of claim 1, wherein the intermediate sidewall is thermally treated by subjecting the sidewall to a temperature of from 450° to 700° F. for 0.01 to 10 minutes.

12. The method of claim 1, including:

electromagnetically expanding at least a portion of the generally cylindrical aluminum sidewall to form the intermediate sidewall.

13. The method of claim 12, including:

providing an external die surrounding the generally cylindrical aluminum sidewall; and expanding the sidewall to substantially conform to the external die.

14. The method of claim 1, including:

electromagnetically expanding at least the expanded portion of the intermediate sidewall to form the final sidewall.

15. The method of claim 14, including:

providing an external die surrounding the intermediate sidewall; and expanding at least the expanded portion of the sidewall to substantially conform to the external die.

16. The method of claim 1, including:

providing the generally cylindrical aluminum sidewall with a substantially uniform thickness of from 0.003 to 0.010 inch.

17. The method of claim 1, including:

providing the generally cylindrical aluminum sidewall with at least one area of increased thickness; and expanding the area of increased thickness to form the intermediate sidewall.

18. The method of claim 17, including:

annealing the at least one area of increased thickness prior to expanding the area.

19. The method of claim 1, wherein the generally cylindrical aluminum sidewall comprises an alloy selected from the group consisting of Aluminum Association alloys 3004, 3104, 3204, 5352 and 5052.

20. The method of claim 19, including:

providing the alloy of the generally cylindrical aluminum sidewall in the H19 temper.

21. The method of claim 20, including:

annealing at least a portion of the generally cylindrical aluminum sidewall to the 0 temper prior to expanding the sidewall.

22. The method of claim 1, including:

expanding the thermally treated portion of the intermediate expanded sidewall to form a second intermediate sidewall having a second intermediate expanded diameter greater than the intermediate expanded diameter;

thermally treating at least the expanded portion of the second intermediate sidewall; and expanding the thermally treated portion of the second intermediate sidewall to form the final sidewall having a final expanded diameter greater than the second intermediate expanded diameter.

23. The method of claim 1, including:

annealing at least a portion of the generally cylindrical aluminum sidewall to the 0 temper prior to expanding the generally cylindrical sidewall;

expanding at least a portion of the annealed generally cylindrical aluminum sidewall to an intermediate expanded diameter at least 5 percent greater than the initial diameter of the generally cylindrical aluminum sidewall;

annealing at least the expanded portion of the intermediate sidewall to the 0 temper; and expanding the annealed sidewall to a final expanded diameter more than 20 percent greater than the initial diameter.

24. A method of reforming a sidewall of a generally cylindrically shaped portion of an aluminum container comprising:

providing a generally cylindrical aluminum sidewall having an initial diameter;

thermally treating at least a portion of the generally cylindrical sidewall;

expanding the thermally treated portion of the generally cylindrical sidewall to form an intermediate sidewall having an intermediate expanded diameter greater than the initial diameter; and expanding at least the intermediate expanded diameter of the Previously expanded intermediate sidewall to form a final sidewall having a final expanded diameter greater than the intermediate diameter.

25. The method of claim 24, wherein the intermediate expanded diameter is up to about 20 percent greater than the initial diameter.

26. The method of claim 25, wherein the final expanded diameter is from about 1 to about 6 percent greater than the intermediate expanded diameter.

* * * * *